US006807252B1

(12) United States Patent
Dobbs

(10) Patent No.: US 6,807,252 B1
(45) Date of Patent: Oct. 19, 2004

(54) METHOD FOR MAKING X-RAY ANTI-SCATTER GRID

(75) Inventor: John M. Dobbs, Hamilton, MA (US)

(73) Assignee: Analogic Corporation, Peabody, MA (US)

( * ) Notice: Subject to any disclaimer, the term of this patent is extended or adjusted under 35 U.S.C. 154(b) by 0 days.

(21) Appl. No.: 10/280,301

(22) Filed: Oct. 24, 2002

Related U.S. Application Data

(60) Provisional application No. 60/346,038, filed on Oct. 24, 2001.

(51) Int. Cl.[7] ..... G21K 1/00
(52) U.S. Cl. ..... 378/154
(58) Field of Search ..... 378/154, 155

(56) References Cited

U.S. PATENT DOCUMENTS 4,465,540 A 8/1984 Albert
4,951,305 A 8/1990 Moore et al.
5,418,833 A * 5/1995 Logan ..... 378/154
5,455,849 A 10/1995 Logan et al.
5,606,589 A 2/1997 Pellegrino et al.
5,729,585 A 3/1998 Pellegrino et al.
5,814,235 A 9/1998 Pellegrino et al.
5,949,850 A * 9/1999 Tang ..... 378/154
6,075,840 A 6/2000 Pellegrino et al.
6,459,771 B1 * 10/2002 Mancini ..... 378/154

OTHER PUBLICATIONS

Tang, Chae–Mei, et al, Precision Fabrication of two–dimensional anti–scatter grids; *Medical Imaging 2000: Physics of Medical Imaging*, pp 647–657.
Tang, Chae–Mei, et al, Experimental and simulation results of two–dimensional prototype anti–scatter grids for mammorgraphy; *World Congress of Medical Physics and Biomedical Engineering*, Jul. 23–28, 2000.

* cited by examiner

*Primary Examiner*—Craig E. Church
(74) *Attorney, Agent, or Firm*—McDermott Will & Emery LLP

(57) ABSTRACT

A method for manufacturing an anti-scatter grid having a desired height. The method includes positioning a bottom surface of a mask of dielectric material, with a depth at least equal to the desired height of the anti-scatter grid, on a sheet of metal, cutting first and second series of intrinsically focused slots through a top surface of the mask to the sheet of metal, plating the sheet of metal at the bottom of each of the slots of the mask with a radiopaque material to form partition walls of the anti-scatter grid, and continuing to plate the radiopaque material into the slots of the mask until the desired height of the anti-scatter grid is achieved.

24 Claims, 8 Drawing Sheets

METHOD FOR MAKING X-RAY ANTI-SCATTER GRID

CROSS-REFERENCE TO RELATED APPLICATION

The present application claims priority from U.S. Provisional Patent Application Serial No. 60/346,038 filed on Oct. 24, 2001, which is assigned to the assignee of the present application and incorporated herein by reference.

FIELD OF THE INVENTION

The present invention generally relates to the field of medical radiography, and more particularly to a method of making an X-ray anti-scatter grid for use in patient diagnostic imaging procedures.

BACKGROUND OF THE INVENTION

Scattered X-ray radiation (sometimes referred to as secondary or off-axis radiation) is generally a serious problem in the field of radiography. Scattered X-ray radiation is a particularly serious problem in the field of X-ray patient diagnostic imaging procedures, such as mammographic procedures, where high contrast images are required to detect subtle changes in patient tissue.

Prior to the present invention, scattered X-ray radiation in patient diagnostic imaging procedures has been reduced through the use of a conventional linear or two-dimensional focused scatter-reducing grid. The grid is interposed between the patient and an X-ray detector and tends to allow only the primary, information-containing radiation to pass to the detector while absorbing secondary or scattered radiation which contains no useful information about the patient tissue being irradiated to produce an X-ray image.

Some conventional focused grids used in patient diagnostic imaging procedures generally comprise a plurality of X-ray opaque lead foil slats spaced apart and held in place by aluminum or fiber interspace filler. In focused grids, each of the lead foil slats, sometimes referred to as lamellae, are inclined relative to the plane of the film so as to be aimed edgewise towards the focal spot of the X-rays emanating from an X-ray source. Usually, during an imaging procedure, the standard practice is to move the focused grid in a lateral direction, perpendicular to the lamellae, so as to prevent the formation of a shadow pattern of grid lines on the X-ray image, which would appear if the grid were allowed to remain stationary. Such moving grids are known as Potter-Bucky grids.

One problem with conventional grids of the type described above is that the aluminum or fiber interspace filler material absorbs some of the primary information-containing X-ray radiation. Because some of the primary radiation is absorbed by the interspace material, the patient must be exposed to a higher dose of radiation than would be necessary if no grid were in place in order to compensate for the absorption losses imposed by the grid. It is an obvious goal in all radiography applications to expose the patient to the smallest amount of radiation needed to obtain an image having the highest image quality in terms of film blackening and contrast.

Another problem with such conventional focused grids of the parallel lamellae type described above is that they do not block scattered radiation components moving in a direction substantially parallel to the plane of the lamellae. The resulting images using these grids have less than optimal darkness and contrast.

U.S. Pat. No. 5,606,589 to Pellegrino, et al. discloses air cross grids for absorbing scattered secondary radiation and improving X-ray imaging in general radiography and in mammography. The grids are provided with a large plurality of open air passages extending through each grid panel. These passages are defined by two large pluralities of substantially parallel partition walls, respectively extending transverse to each other. Each grid panel is made by laminating a plurality of thin metal foil sheets photo-etched to create through openings defined by partition segments. The etched sheets are aligned and bonded to form the laminated grid panel, which is moved edgewise during the X-ray exposure to pass primary radiation through the air passages while absorbing scattered secondary radiation arriving along slanted paths.

The method of Pellegrino, et al. produces sturdy cellular air cross grids having focused air passages offering maximum radiation transmissivity area and minimum structural area necessarily blocking primary radiation, while maintaining adequate structural integrity for the cross grid during use. The air cross grids maximize contrast and accuracy of the resulting mammograms produced with the same or comparable radiation dosages. However, present techniques for producing grids are unable to produce grids having a very fine pitch that is necessary for use with digital plates.

What is still desired, however, are improved techniques for making focused anti-scatter grids with finer pitch. Preferably, such improved techniques will be relatively easier, less time-consuming and less expensive than existing techniques for making focused anti-scatter grids.

Exemplary embodiments of the present invention provide techniques for making focused anti-scatter grids efficiently and with high precision in those attributes which are important. One exemplary embodiment of a method according to the present invention for manufacturing an anti-scatter grid having a desired height includes positioning a bottom surface of a mask of dielectric material, with a depth at least equal to the desired height of the anti-scatter grid, on a sheet of metal. First and second series of intrinsically focused slots are then cut through a top surface of the mask to the sheet of metal, and the sheet of metal is plated at the bottom of each of the slots of the mask with a radiopaque material to form partition walls of the anti-scatter grid. Plating the radiopaque material into the slots of the mask is continued until the desired height of the anti-scatter grid is achieved.

According to one aspect of the present invention, the mask is cut by attaching the top surface of the mask to a steel "comb" having teeth forming a plurality of parallel slots, mounting a conductor at a "focal" spot, positioning the bottom surface of the mask on a "detector" plane, and connecting a high-resistance wire to the conductor and insulating the wire from the comb. Then, the high-resistance wire is pulled taunt, a charge is applied through the high-resistance wire, and the first series of intrinsically focused slots are cut in the mask by passing the taunt, charged, high-resistance wire along each tooth of the comb. Then, the comb is detached from the top surface of the mask, rotated 90° from its original orientation on the mask, and reattached to the top surface of the mask. The second series of intrinsically focused slots are then cut in the mask by passing the high-resistance wire along each tooth of the comb.

According to another aspect of the present invention, the mask is cut by positioning the bottom surface of the mask on a "detector".plane, positioning a mirror mounted on a two-axis gimbals at a "focal" spot, directing a laser beam off the mirror and onto the top surface of the mask, and operating the mirror so that the first and the second series of focused slots are cut by the laser beam in the mask. Alternatively, the laser can remain fixed and the mask can be moved relative to the laser beam.

Additional aspects and advantages of the present invention will become readily apparent to those skilled in this art from the following detailed description, wherein exemplary embodiments of the present invention are shown and described, simply by way of illustration of the best modes contemplated for carrying out the present invention. As will be realized, the present invention is capable of other and different embodiments and its several details are capable of modifications in various obvious respects, all without departing from the invention. Accordingly, the drawings and description are to be regarded as illustrative in nature, and not as restrictive.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION EXEMPLARY EMBODIMENT

Figure 1:
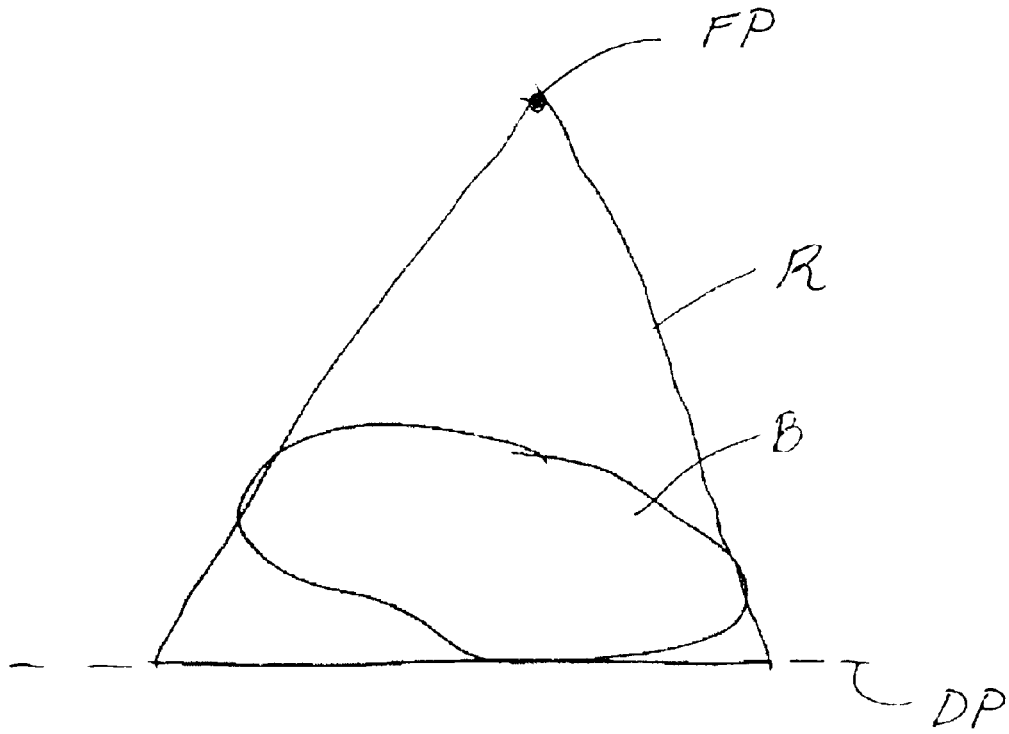
FIG. 1 is a schematic illustration showing X-rays passing from a source at a focal point, through an object such a patient's body, and to a detector plane.
Figure 2:
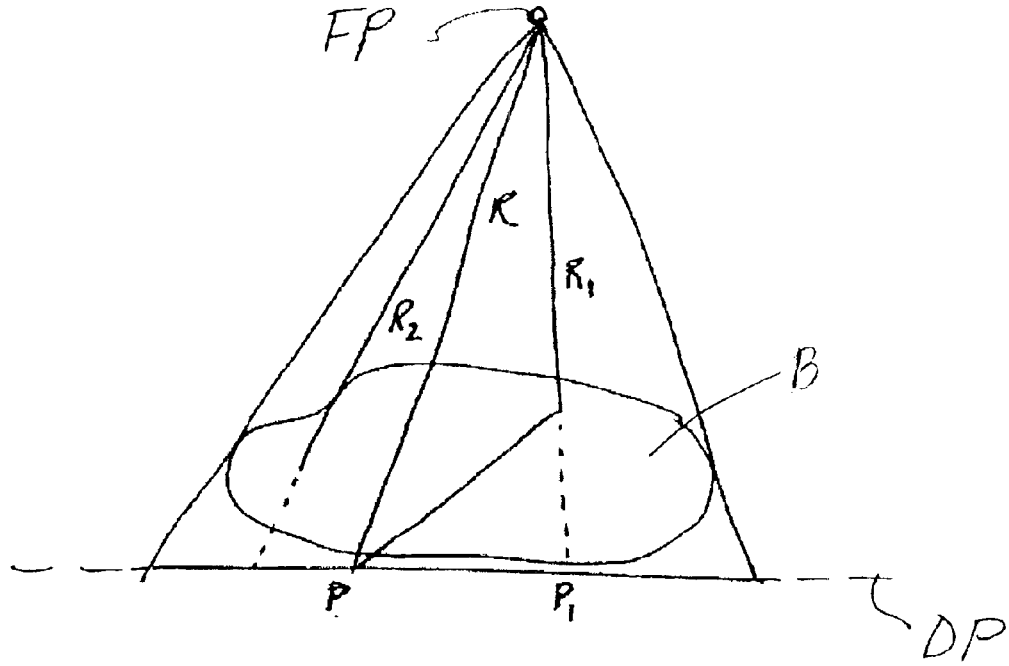
FIG. 2 is a schematic illustration showing X-rays passing from a source at a focal point, through an object such a patient's body, and to a detector plane, and wherein some of the X-rays are shown being deflected or scattered before reaching the detector plane.

X-ray imaging uses the fact that x-rays "R" are extremely penetrating but are absorbed by the material "B" (such as a patient's body) through which they pass. An x-ray image is the two-dimensional map of the x-ray absorption of the material "B" lying between an x-ray source located at a focal point "FP" and an X-ray detector located at a detector plane "DP". FIG. 1 shows a typical medical x-ray imaging situation. The quality of the image depends on the fact that a significant fraction of the x-rays R are absorbed rather than scattered. Referring to FIG. 2, Ray R is emitted from the source located at the focal point FP and detected at point P by the X-ray detector located at the detector plane DP. Ray $R_1$ scatters and is also detected at the point P. Ray $R_2$ is totally absorbed and, therefore, not detected. In the making of an image, occurrences such as these happen many millions of times.

The fact that $R_1$ scattered and was detected at P causes density along the ray $R_1$ to be appropriately assigned to the point $P_1$. However, the point P receives radiation from the ray $R_1$ and, therefore, the density along the ray R is measured to be lower than it actually is. Since scattering occurs in all directions, there is very little spatial information contained in the scattered radiation. The scattered radiation tends to blur the image and lower the measured absorption of localized regions of high absorption.

Figure 3:
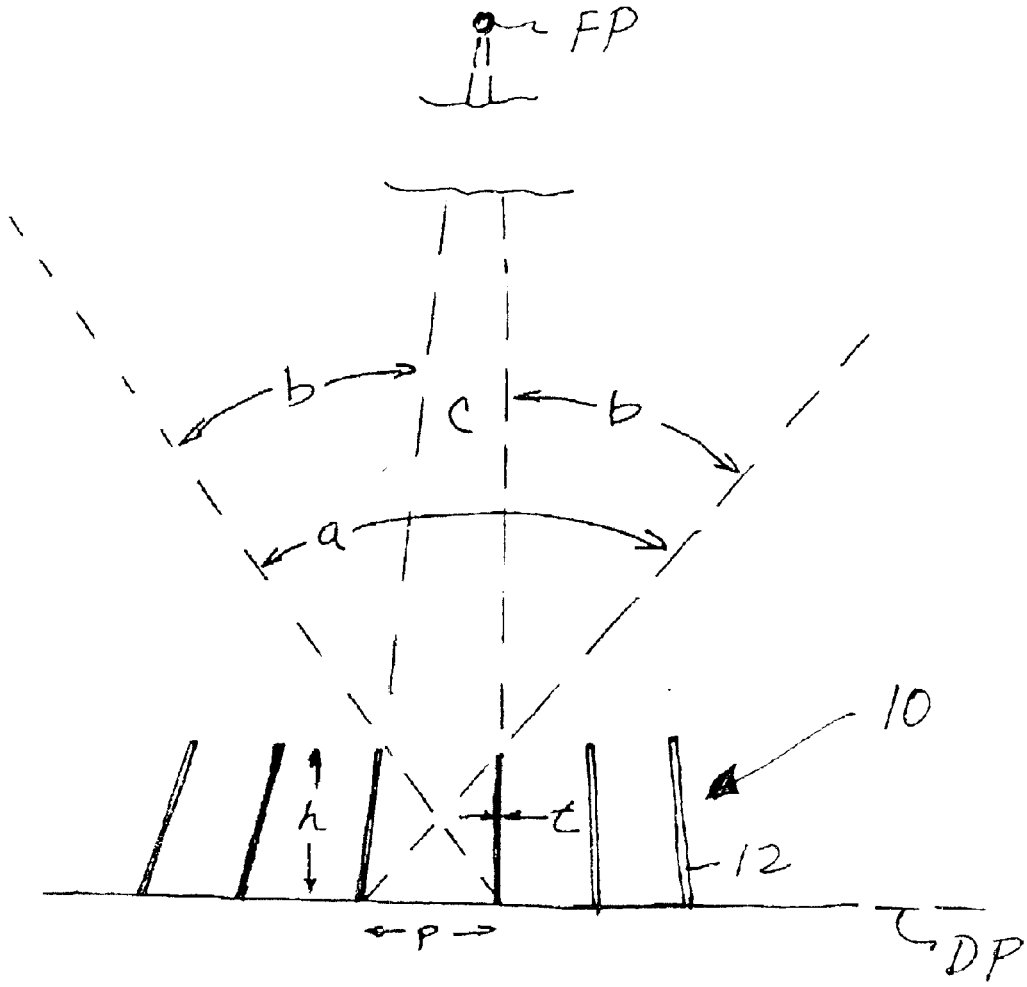
FIG. 3 is a schematic illustration showing an exemplary embodiment of an anti-scatter grid constructed in accordance with the present invention and positioned between a source at a focal point and a detector plane, and illustrating how the anti-scatter grid prevents deflected or scattered X-rays from reaching the detector plane.
Figure 4:
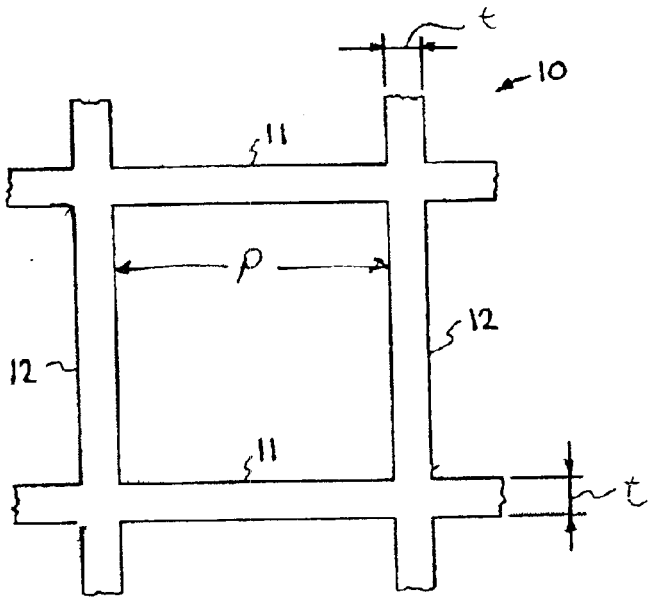
FIG. 4 is a top plan view of a portion of the grid of FIG. 3.
Figure 5:
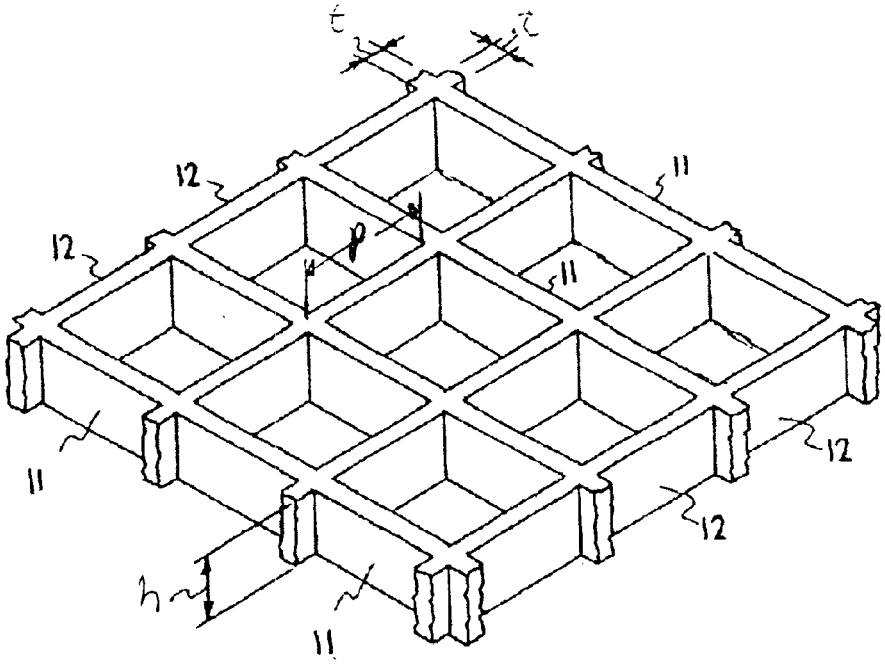
FIG. 5 is a top perspective view of a portion of the grid of FIG. 3.

This problem can be ameliorated by placing a grid 10 of plates 11, 12 in front of the X-ray detector DP which prevents the scattered radiation from reaching the detector, as shown in FIG. 3. The grid 10, which is also shown in FIGS. 4 and 5, is formed of a radiopaque material, such as lead, tungsten, copper or nickel. Each of these plates 11, 12 should be positioned so that the focal spot FP lies in the plane of the plate 11, 12. As illustrated in FIG. 3, it is clear that scattered radiation emanating from outside region (a) will not be detected; a fraction of the radiation emanating from the two regions labeled (b) will be detected; and all the radiation emanating from (c) will be detected.

Furthermore, it is clear that this grid 10 will remove some of the unscattered radiation because the plates 11, 12 have a finite thickness "t". For a one-dimensional grid, the geometric efficiency of the grid 10 is $(p-t)/p$ where "p" is the period of the grid. For a two-dimensional grid, the geometric efficiency of the grid is $((p-t)/p)^2$. It is also clear that the effectiveness of the grid 10 in removing scattered radiation increases as the ratio h/p increases, where "h" is the height of the grid 10 in the direction of the x-ray beam.

Exemplary embodiments of the present invention provide techniques for making the focused anti-scatter grid 10 of FIGS. 3 through 5 efficiently and with high precision in those attributes which are important. The resulting grid structure is a sturdy and highly useful implement in the X-ray patient diagnostic imaging field, and provides the desired absorption of scattered secondary radiation. In addition, techniques conducted in accordance with the present invention can go to smaller characteristic dimensions, are relatively easier, less time-consuming and less expensive than existing techniques for making focused anti-scatter grids.

Figure 6:
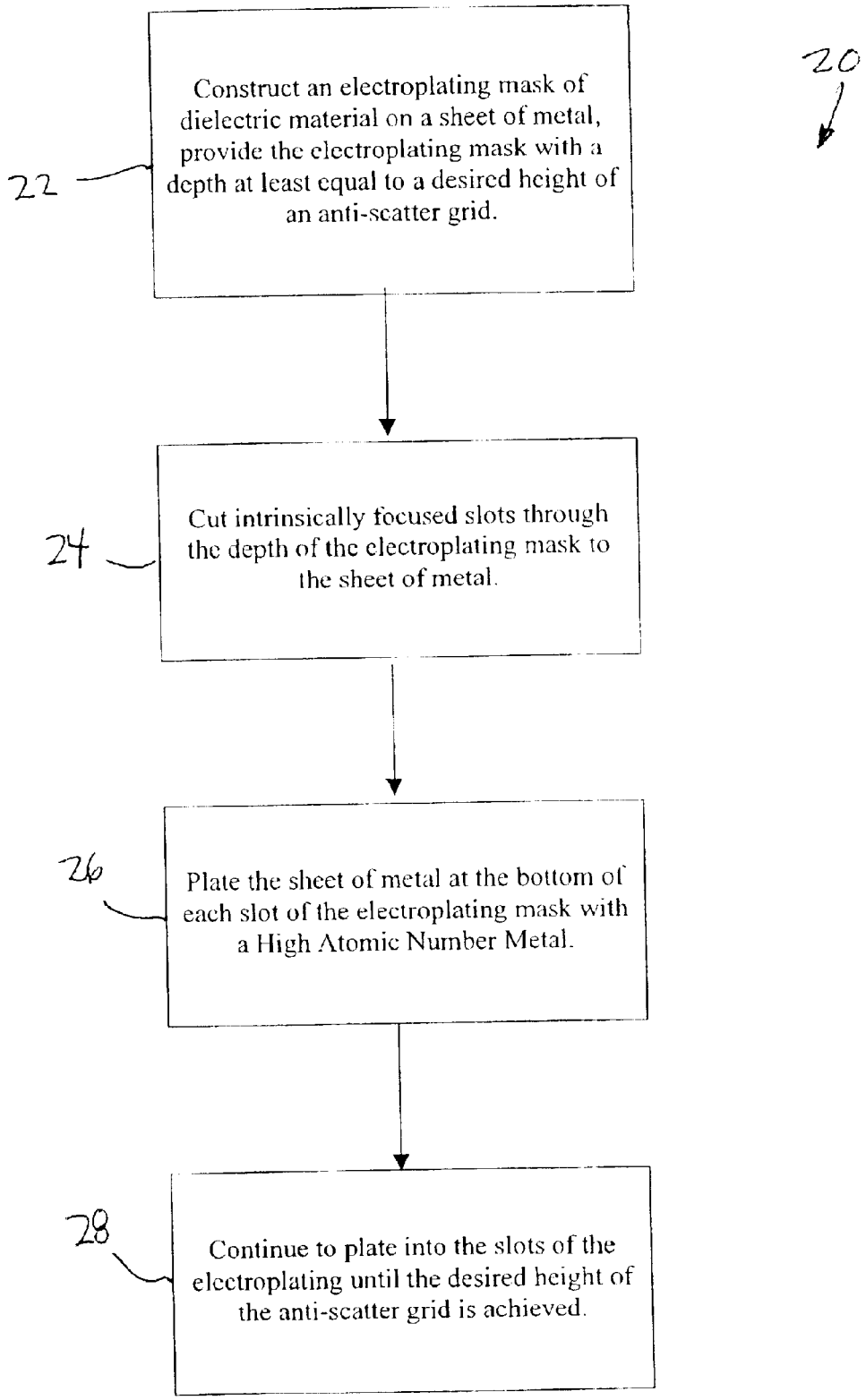
FIG. 6 is a flow chart illustrating an exemplary embodiment of a method of manufacturing the anti-scatter grid of FIG. 3 using a mask, in accordance with the present invention.

One exemplary embodiment of a method (the exemplary embodiment of the method is illustrated as a flow chart labeled as reference numeral "20" in FIG. 6) according to the present invention for manufacturing the anti-scatter grid 10 having a desired height h (with reference to FIG. 3) and includes positioning a bottom surface of a mask of dielectric material, with a depth at least equal to the desired height of the anti-scatter grid, on a sheet of metal, as shown at 22 of FIG. 6. First and second series of intrinsically focused slots are then cut through a top surface of the mask to the sheet of metal, as shown at 24 of FIG. 6, and the sheet of metal is plated at the bottom of each of the slots of the mask with a radiopaque material to form partition walls of the anti-scatter grid, as shown at 26 of FIG. 6. Plating the radiopaque material into the slots of the mask is continued, as shown at 28 of FIG. 6, until the desired height h of the anti-scatter grid 10 (with reference to FIG. 3) is achieved.

Figure 7:
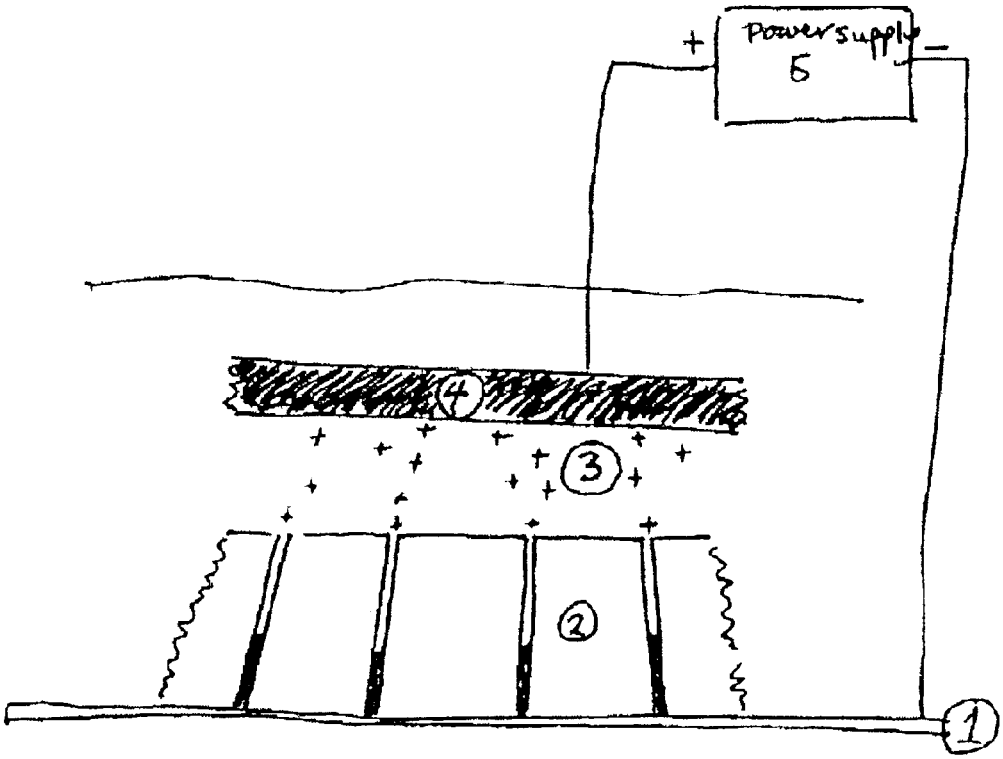
FIG. 7 a schematic illustration showing an exemplary embodiment of a method of plating the anti-scatter grid of FIG. 3 using the mask in accordance with the method of FIG. 6.

FIG. 7 a schematic illustration showing an exemplary embodiment of a method of plating the anti-scatter grid 10 of FIGS. 3 through 5 using the mask in accordance with the method of FIG. 6. The metal plate 1, on which the dielectric plating mask 2 is bonded, is immersed in an electrolyte 3 containing ions of the desired radiopaque material. An anode 4 of the same radiopaque material is placed in the electrolyte. The anode is connected to the positive terminal of a power supply 5 and the metal plate 1 (cathode), with the plating mask, is connected to the negative terminal. Positive ions are driven to the negatively charged cathode. By this technique, radiopaque material will build up in the slots resulting in a grid 10 of radiopaque material being formed.

Figure 8:
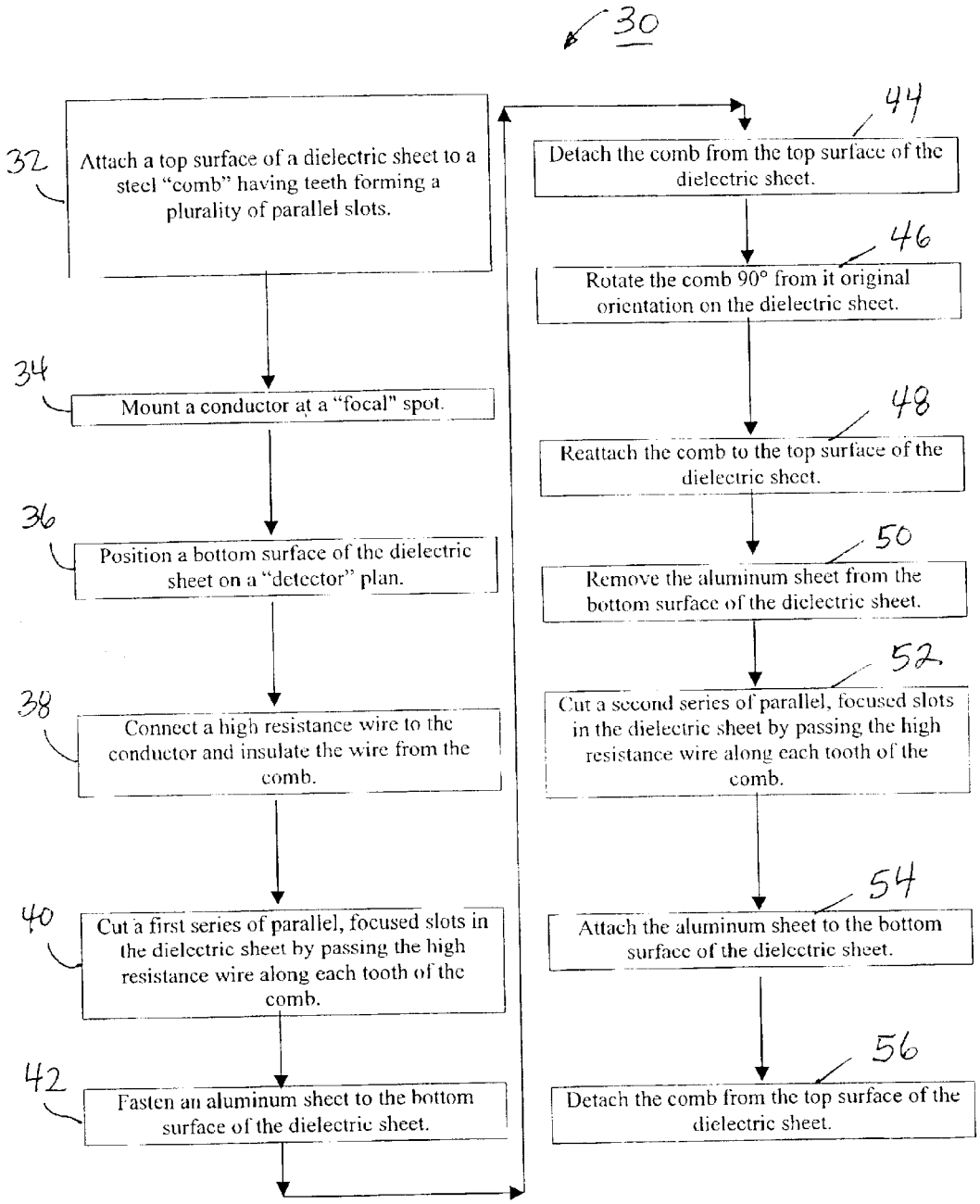
FIG. 8 is a flow chart illustrating an exemplary embodiment of a method of cutting the mask of FIG. 6 in accordance with the present invention.

FIG. 8 is a flow chart illustrating an exemplary embodiment of a method 30 of cutting the mask 2 of FIG. 7 in accordance with the present invention. As the flow chart illustrates, the mask is cut by attaching the top surface of the mask to a steel "comb" having teeth forming a plurality of parallel slots, as shown at 32, mounting a conductor, such as a stranded copper wire, at the focal spot of the grid, as shown at 34, positioning the bottom surface of the mask on the detector plane, as shown at 36, connecting a high-resistance wire to the conductor and insulating the wire from the comb, as shown at 38, and pulling the high-resistance wire taunt, applying a charge through the high-resistance wire, and cutting the first series of intrinsically focused slots in the mask by passing the taunt, charged high-resistance wire along each tooth of the comb, as shown at 40.

Figure 8A:
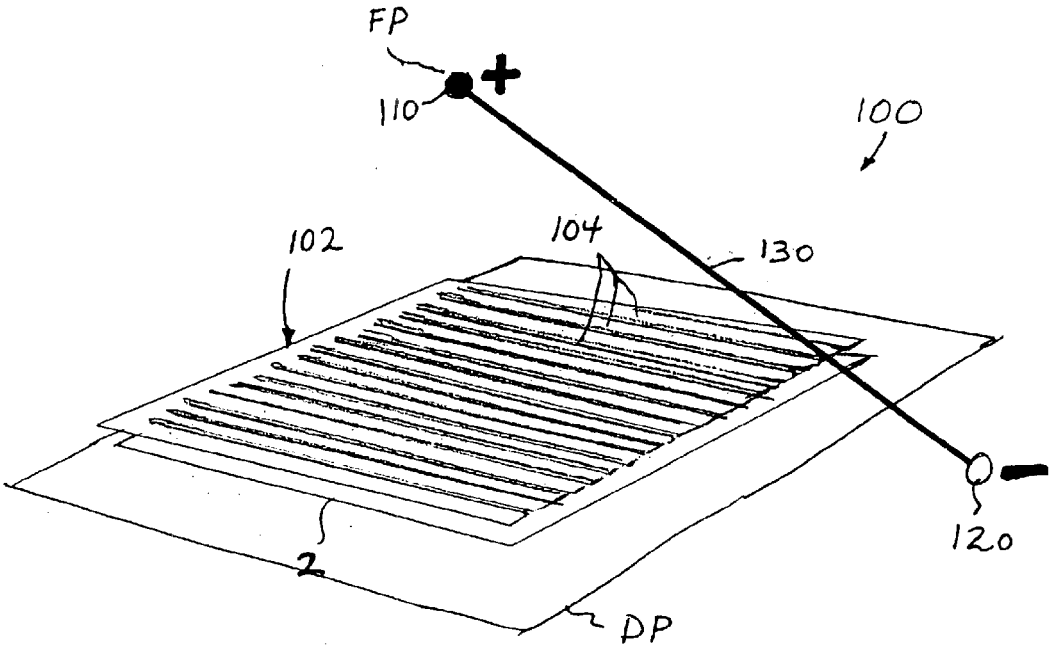
FIG. 8A a perspective view of an exemplary embodiment of an apparatus for conducting the method of FIG. 8.

FIG. 8A illustrates an exemplary embodiment of an apparatus 100 that can be utilized in performing the electric machining of the method 30 of FIG. 8. The apparatus 100 includes an electrically insulated "comb" 102 having teeth 104 forming a plurality of parallel slots, which can attached to a top surface of the mask 2. The mask 2 is positioned on an imaginary detector plane DP and the apparatus 100 includes a first electrical connector 110 positioned at an imaginary focal spot FP, with reference to the imaginary detector plane DP. The first electrical connector 110 is fixed in position. The apparatus 100 also includes a second electrical connector 120, which is movable with respect to the first electrical connector 110, and an elongated high-resistance electrical conductor 130, such as a stranded copper wire, connected and pulled taunt between the first and the second electrical connectors 110, 120. As described previously, during a procedure wherein intrinsically focused slots are cut in the mask 2 with the apparatus 100, a charge is applied through the high-resistance wire 130 so that the wire is heated. Then the second electrical connector 120 is moved so that the taunt, electrified, high-resistance wire 130 is passed along each tooth 104 of the comb 102.

The method 30 further includes attaching the metal sheet to the bottom surface of the mask, as shown at 42, detaching the comb from the top surface of the mask, as shown at 44, rotating the comb 90° from its original orientation on the mask, as shown at 46, and reattaching the comb to the top surface of the mask, as shown at 48. Then the metal sheet is removed from the bottom surface of the mask, as shown at 50, and the second series of intrinsically focused slots is cut in the mask by passing the high-resistance wire along each tooth of the comb, as shown at 52. The metal sheet is then reattached to the bottom surface of the mask, as shown at 54, and the comb is detached from the top surface of the mask, as shown at 56.

Figure 9A:
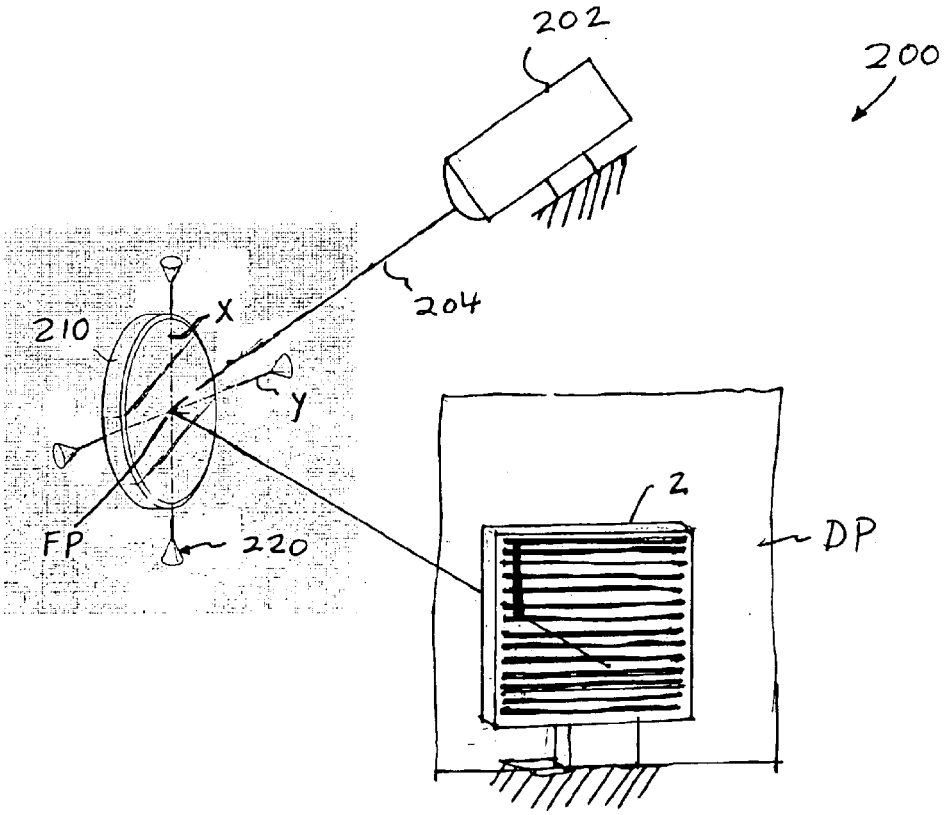
FIG. 9A a perspective view of an exemplary embodiment of an apparatus for conducting the method of FIG. 9.
Figure 9:
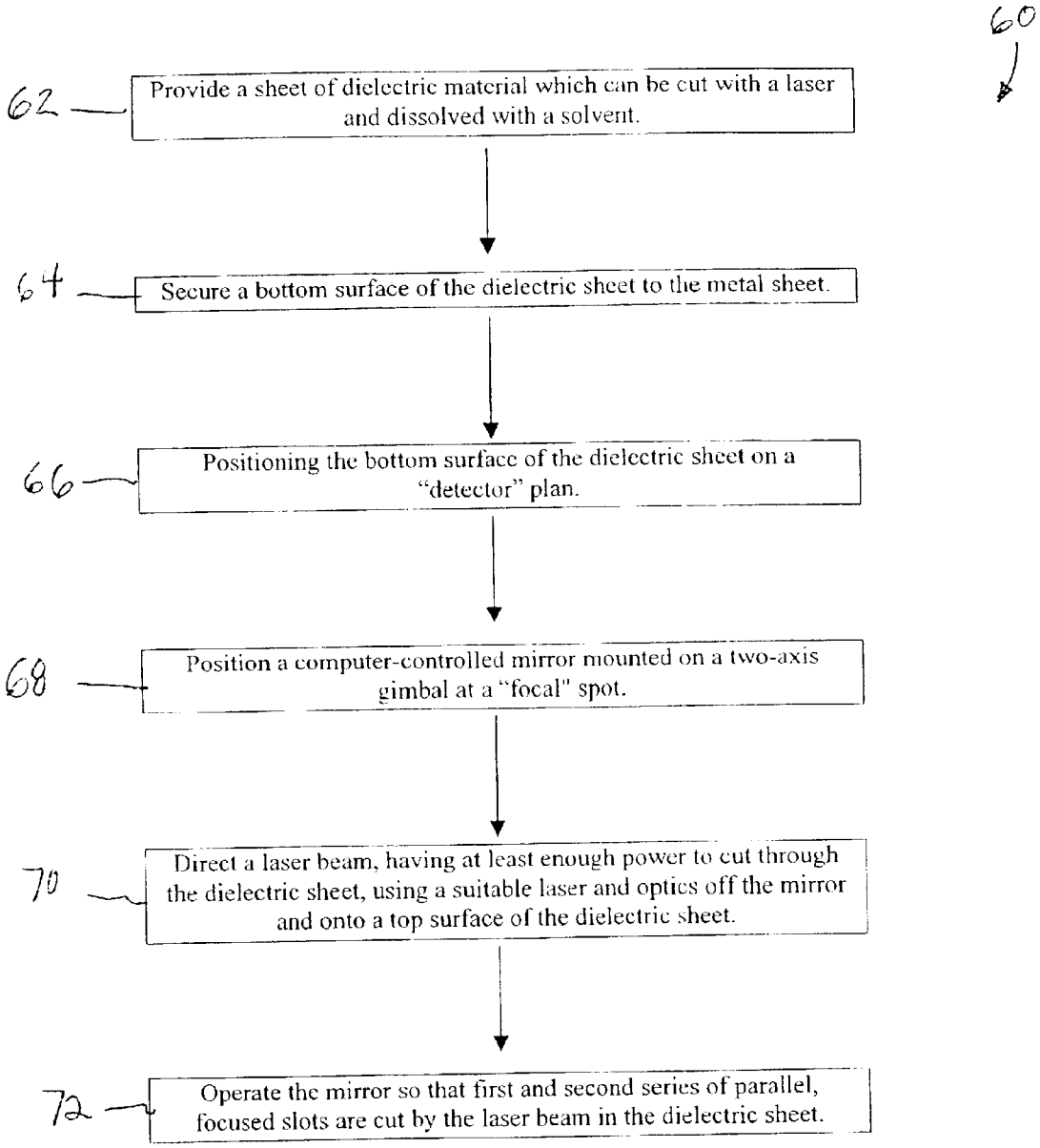
FIG. 9 is a flow chart illustrating another exemplary embodiment of a method of cutting the mask of FIG. 6 in accordance with the present invention.

FIG. 9 is a flow chart illustrating another exemplary embodiment of a method 60 of cutting the mask 2 of FIG. 7 in accordance with the present invention. The mask comprises dielectric material which can be cut with a laser and dissolved with a solvent, as shown at 62, and is attached to the metal sheet, as shown at 64. The mask is cut by positioning the bottom surface of the mask on a "detector" plane, as shown at 62, positioning a mirror mounted on a two-axis gimbals at a "focal" spot, as shown at 68, directing a laser beam off the mirror and onto the top surface of the mask, as shown at 70, and operating the mirror so that the first and the second series of focused slots are cut by the laser beam in the mask, as shown at 72.

This laser should have enough power to cut through the mask. The laser and optics should be suitable to cut slots which are 100 microns or smaller. It may be useful to use a beam which is wide in the direction of the cut and very narrow perpendicular to the cut. This would allow much greater power to be applied to the mask; however, it would add complexity to the optics. The computer-controlled gimbals can be moved using standard motion control techniques either with servomotors, stepper motors, or other techniques such as piezoelectric actuators. Both coordinates must be controlled at the same time. Alternatively, the laser can remain fixed and the mask can be moved relative to the laser beam.

A second option is to place a photomask in the laser beam, which will cast a shadow on the mask. This shadow is precisely in the form of the desired final plating mask. Using this technique, a much larger laser beam can be used which will cut many slots simultaneously. This beam will also be scanned from a single spot so that the slots, which are cut in the mask, converge on that spot.

FIG. 9A illustrates an exemplary embodiment of an apparatus 200 that can be utilized in performing the laser cutting of the method 60 of FIG. 9. The apparatus 200 includes a laser source 202 and a mirror 210 mounted on a two-axis gimbal positioner 220. A two-axis gimbal positioner 220 provides titling movement with respect to two perpendicular axes, such as the x and y axes, as shown (two-axis gimbal positioners with motorized actuators are available, for example, from Microwave Instrumentation Technologies, LLC of Duluth Ga., http://www.mi-technologies.com, and Newport Corporation of Irvine Calif., http://www.newport.com). The mask 2 is cut by positioning the bottom surface of the mask on a detector plane DP, positioning the mirror 210 at the focal spot FP, directing a laser beam 204 from the laser source 202 off the mirror 210 and onto the top surface of the mask 2, and operating the two-axis gimbal positioner 220 so that first and second series of slots are cut in the mask 2 by the laser beam 204.

A stainless steel (or other suitable metal) frame is attached to the aluminum sheet to provide a mounting means for the anti-scatter grid. The frame is connected electrically to the aluminum sheet so that during plating the anti-scatter grid is attached to the frame. The surface of the frame, which should not be plated, must be masked with a thick coat of wax.

According to one exemplary embodiment, the metal sheet comprises aluminum and the mask comprises a fine grain styrene foam. The mask is secured to the metal sheet using hot wax, and the wax is scraped from the metal sheet at the bottom of each slot of the mask prior to plating. A lower surface of the metal sheet is coated with wax prior to plating.

The mask is secured to the comb using hot wax, and the comb is heated to remove the comb from the top surface of the mask The surface of the aluminum sheet and the frame should be clean and free of contaminants so that a good bond can be achieved between the plated structure and the frame. If the surface of the metal to be plated is not perfectly clean, it may be necessary to etch it or clean it chemically or electrochemically in some way.

When the aluminum plate with the plating mask and the frame are completed, they are placed in a plating bath. At this point, a radiopaque material is plated through the slots in the plating mask on to the aluminum of the backing plate and the stainless steel (or other suitable metal) of the frame. The plating continues until the grid is thick enough. At this point, the radiopaque material of the grid may be smooth and uniform, in which case the aluminum backing electrode may be dissolved in sodium hydroxide, or other agent for dissolving the metal sheet without dissolving the grid, the plating mask dissolved in an organic solvent, and the grid carefully cleaned. Alternatively, the metal sheet, can be provided as a very thin layer secured onto a thicker layer of radiolucent material, such as carbon fiber. In this manner, the combination of the thin layer of the metal sheet and the thicker layer of the radioluscent material can remain attached to the grid without substantially interfering the passage of x-rays through the grid. The metal sheet can also be provided as a very thin layer of a metal grid secured to a thicker support layer of radiolucent material.

If the radiopaque material of the grid is uneven, the grid should be machined in some fashion to make it uniform. This is probably best done while the plating mask is still supporting the grid. After this, the aluminum electrode and plating mask are removed as explained above. When the grid is completely clean, a very thin layer of carbon fiber laminate or other suitable material may be glued to each face of the grid and the frame to protect and stabilize the grid.

Alternately, the surface of the radiopaque material may be left rough so long as it is entirely within the slots of the plating mask. Furthermore, under some circumstances, the plating mask may be left in place since its absorption of x-rays is very small compared to that of the radiopaque material.

It will thus be seen that the objects set forth above, and those made apparent from the preceding description, are efficiently attained and, since certain changes may be made in carrying out the above method and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method for manufacturing an anti-scatter grid having a desired height comprising:

positioning a bottom surface of a mask of dielectric material, with a depth at least equal to the desired height of the anti-scatter grid, on a sheet of metal;

cutting first and second series of intrinsically focused slots through a top surface of the mask to the sheet of metal:

plating the sheet of metal at the bottom of each of the slots of the mask with a radiopaque material to form partition walls of the anti-scatter grid; and continuing to plate the radiopaque material into the slots of the mask until the desired height of the anti-scatter arid is achieved, wherein the mask is cut by:

attaching the top surface of the mask to a steel "comb" having teeth forming a plurality of parallel slots;

mounting a conductor at a "focal" spot;

positioning the bottom surface of the mask on a "detector" plane;

connecting a high-resistance wire to the conductor and insulating the wire from the comb;

pulling the high-resistance wire taunt, applying a charge through the high-resistance wire, and cutting the first series of intrinsically focused slots in the mask by passing the taunt, charged high-resistance wire along each tooth of the comb;

attaching the metal sheet to the bottom surface of the mask;

detaching the comb from the top surface of the mask;

rotating the comb 90° from its original orientation on the mask;

reattaching the comb to the top surface of the mask;

removing the metal sheet from the bottom surface of the mask;

cutting the second series of intrinsically focused slots in the mask by passing the high-resistance wire along each tooth of the comb;

attaching the metal sheet to the bottom surface of the mask; and detaching the comb from the top surface of the mask.

2. A method according to claim 1, wherein the mask is cut by:

positioning the bottom surface of the mask of dielectric material on a "detector" plane, while leaving a top surface of the mask of dielectric material uncovered;

positioning a mirror mounted on a two-axis gimbals at a "focal" spot;

directing a laser beam off the mirror and onto the top surface of the mask of dielectric material; and operating the mirror so that the first and the second series of focused slots are cut by the laser beam in the mask of dielectric material.

3. A method according to claim 2, further comprising mounting and electrically connecting a frame to the metal sheet.

4. A method according to claim 3, wherein the frame is comprised of stainless steel.

5. A method according to claim 2, wherein the metal sheet is comprised of aluminum.

6. A method according to claim 2, wherein the mask comprises a fine grain styrene foam.

7. A method according to claim 2, wherein the mask is secured to the metal sheet using hot wax.

8. A method according to claim 7, wherein wax is scraped from the metal sheet at the bottom of each slot of the mask prior to plating.

9. A method according to claim 2, wherein the mask is secured to the comb using hot wax.

10. A method according to claim 9, wherein the comb is heated to remove the comb from the top surface of the mask.

11. A method according to claim 9, further comprising coating a lower surface of the metal sheet with wax prior to plating.

12. A method according to claim 3, further comprising coating the frame with wax prior to plating.

13. A method according to claim 2, wherein the conductor comprises a stranded copper wire.

14. A method according to claim 1, wherein the sheet of metal is plated at the bottom of each slot of the mask with a radiopaque material by:

immersing the metal sheet and the mask in an electrolyte containing ions of the desired radiopaque material;

placing an anode of the same radiopaque material in the electrolyte;

connecting the anode to a positive terminal of a power supply; and connecting the sheet of metal to a negative terminal of the power supply.

15. A method according to claim 1, wherein the metal sheet is dissolved after the grid is plated.

16. A method according to claim 1, wherein the mask is dissolved after the grid is plated.

17. A method according to claim 1, wherein the grid is cleaned after plating.

18. A method according to claim 1, wherein the grid is machined after plating.

19. A method according to claim 1, further comprising:

dissolving the metal sheet;

dissolving the mask; and securing very thin layers of carbon fiber laminate to opposite faces of the grid.

20. A method according to claim 1, wherein the grid is comprised of a radiopaque material that is undissolvable by a predetermined agent and the metal plate is comprised of a material that dissolvable by the predetermined agent.

21. A method according to claim 20, wherein the predetermined agent comprises sodium hydroxide.

22. A method according to claim 1, wherein the metal sheet is relatively thin and provided on a relatively thicker sheet of radiolucent material.

23. A method according to claim 22, wherein the radiolucent material comprises carbon fiber.

24. A method according to claim 22, wherein the metal sheet is provided as a grid substantially in registration with the slots of the mask.

* * * * *